US008224225B2

(12) United States Patent
Sakurai

(10) Patent No.: US 8,224,225 B2
(45) Date of Patent: Jul. 17, 2012

(54) WASTE POWDER RECOVERY CONTAINER, CONNECTING STRUCTURE TO WASTE POWDER RECOVERY CONTAINER, DEVELOPING DEVICE, AND IMAGE FORMING APPARATUS

(75) Inventor: Hideto Sakurai, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 299 days.

(21) Appl. No.: 12/640,488

(22) Filed: Dec. 17, 2009

(65) Prior Publication Data

US 2010/0166461 A1 Jul. 1, 2010

(30) Foreign Application Priority Data

Dec. 25, 2008 (JP) ..... 2008-329356

(51) Int. Cl.
*G03G 21/12* (2006.01)

(52) U.S. Cl. ..... 399/360; 399/119

(58) Field of Classification Search ..... 399/38, 399/75, 107, 110, 111, 119, 120, 343, 358, 399/360; 222/DIG. 1
See application file for complete search history.

(56) References Cited

U.S. PATENT DOCUMENTS

| | | | | |
|---|---|---|---|---|
| 6,937,838 | B2 * | 8/2005 | Ishii et al. | 399/358 |
| 7,831,190 | B2 * | 11/2010 | Yang | 399/360 |
| 2006/0120779 | A1 * | 6/2006 | Uchihashi | 399/358 |
| 2008/0118290 | A1 * | 5/2008 | Sato | 399/358 |

FOREIGN PATENT DOCUMENTS

| | | | |
|---|---|---|---|
| JP | 2000-98722 | A | 4/2000 |
| JP | 2008-134395 | A | 6/2008 |

* cited by examiner

*Primary Examiner* — David Gray
*Assistant Examiner* — Benjamin Schmitt
(74) *Attorney, Agent, or Firm* — Buchanan Ingersoll & Rooney PC

(57) ABSTRACT

A waste powder recovery container is detachably attached to an image forming apparatus, and further, is provided with a recovery port, through which waste powder discharged from a component part constituting a process unit is recovered, at one end in a longitudinal direction and an inclined surface on the container side, which is gradually inclined downward in a lateral direction and has the recovery port formed thereat. The inclined surface on the container side moves an opening/closing member disposed in a discharging portion formed at the component part constituting the process unit by pushing an inclined surface on a main body side formed at the opening/closing member, thereby opening a discharging port formed at the discharging portion, to discharge the waste powder and recover the waste powder through the recovery port.

6 Claims, 13 Drawing Sheets

WASTE POWDER RECOVERY CONTAINER, CONNECTING STRUCTURE TO WASTE POWDER RECOVERY CONTAINER, DEVELOPING DEVICE, AND IMAGE FORMING APPARATUS

This application is based on Japanese Patent Application No. 2008-329356 filed in Japan on Dec. 25, 2008, the entire content of which is hereby incorporated by reference

BACKGROUND OF THE INVENTION

1. Field of the Invention

The present invention relates to a waste powder recovery container, a connecting structure to a waste powder recovery container, a developing device, and an image forming apparatus.

2. Description of the Related Art

In a conventional image forming apparatus of a so-called trickle type, in which a developer containing degraded carriers is discharged whereas a fresh developer is replenished, a waste developer to be discharged from a developing device is recovered in a waste powder recovery container. In such an image forming apparatus of the trickle type, a cylindrical discharging portion for discharging a developer is provided on a side of the developing device, and further, a developer discharging port, into which the discharging portion is inserted, is provided on a side of the waste powder recovery container (see, for example, Japanese Unexamined Patent Publication Nos. 2000-98722 and 2008-134395).

In the conventional image forming apparatus, a waste toner scraped from an image carrier is also recovered in the waste powder recovery container for the purpose of space saving and cost reduction. Therefore, there arises the following problem: the waste toner recovered in the waste powder recovery container is liable to fly. When the flying waste toner attaches to the discharging portion which is inserted into the waste powder recovery container, the discharging portion, to which the flying waste toner attaches, is exposed when replacing the waste powder recovery container, and then, the waste toner flies around, thereby adversely influencing the image forming processing.

SUMMARY OF THE INVENTION

The present invention has been accomplished to solve the above-described problem, and an object of the present invention is to provide a waste powder recovery container provided with a structure in which a discharging portion cannot be smeared with a waste powder even if all kinds of waste powder to be discharged from process units are recovered in a single container, a connecting structure to a waste powder recovery container, a developing device, and an image forming apparatus.

To solve the above-described problem, in the present invention, there is provided a waste powder recovery container detachably attached to an image forming apparatus and provided with a recovery port, through which waste powder discharged from a component part constituting a process unit is recovered, the waste powder recovery container including: an inclined surface on the container side, which is gradually inclined downward in an attachment direction to the image forming apparatus and has the recovery port formed thereat, wherein the inclined surface on the container side moves an opening/closing member disposed in a discharging portion formed at the component part constituting the process unit by pushing an inclined surface on a main body side formed at the opening/closing member, thereby opening a discharging port formed at the discharging portion, to discharge the waste powder and recover the waste powder through the recovery port.

In this case, the process unit includes component parts such as an image forming unit or a cleaning unit for discharging a waste powder such as a toner or a developer.

With the above-described configuration, the inclined surfaces are brought into press-contact with each other only by installing the waste powder recovery container in the image forming apparatus, so that the discharging port and the recovery port can communicate with each other. The discharging portion does not project into the waste powder recovery container, and therefore, a flying waste powder does not attach to the discharging portion.

To solve the above-described problem, in the present invention, there is provided a connecting structure to a waste powder recovery container including: a discharging portion including a discharge pipe disposed in a component part constituting a process unit in an image forming apparatus and provided with a discharging port at a lower portion of a tip; an opening/closing member which covers the tip of the discharge pipe, has an inclined surface on a main body side, and is fixed in a freely reciprocating manner in an axial direction of the discharge pipe, so as to open or close the discharging port; and a biasing member for urging the opening/closing member in a projection direction from the discharge pipe; and a recovery port for recovering a waste powder discharged from the component part, the recovery port being formed in a waste powder recovery container detachably attached to the image forming apparatus and disposed at an inclined surface on a container side, gradually inclined downward in an attachment direction to the image forming apparatus; wherein when the waste powder recovery container is installed in the image forming apparatus, the inclined surface on the container side presses the inclined surface on the main body side so as to push the opening/closing member to open the discharging port, so that the waste powder discharged from the component part through the recovery port is recovered into the waste powder recovery container.

To solve the above-described problem, in the present invention, there is provided a developing device which circulates and moves a developer contained inside a developer container while agitating the developer by conveying means, supplies the developer to a developer carrier, discards a degraded developer from a discharging portion to a waste powder recovery container, and replenishes a fresh developer from a replenishing portion, the discharging portion in the developer container including: a discharge pipe having a discharging port at a lower portion of a tip; an opening/closing member which covers the tip of the discharge pipe, and is fixed in a freely reciprocating manner in an axial direction of the discharge pipe so as to open or close the discharging port; and a biasing member for biasing the opening/closing member in a projection direction from the discharge pipe, and the opening/closing member having an inclined surface on a main body side, gradually inclined upward toward the tip; wherein when the waste powder recovery container is installed in the image forming apparatus, the inclined surface on the main body side is pushed to an inclined surface on a container side, which is formed at the waste powder recovery container, is gradually inclined downward in an attachment direction to the image forming apparatus, and has a recovery port, so as to move the opening/closing member, thus opening the discharging port, so that the degraded developer is recovered to the waste powder recovery container through the recovery port.

Preferably, the biasing member is interposed between an extending portion extending from the opening/closing member and a part of the developer container, so as to suppress a length in an axial direction at a portion covering the discharge pipe of the opening/closing member.

To solve the above-described problem, in the present invention, there is provided an image forming apparatus including: an apparatus main body; a component part constituting a process unit, housed inside the apparatus main body and provided with a discharging portion, through which waste powder is discharged, the discharging portion including: a discharge pipe having a discharging port formed at a lower portion of a tip; an opening/closing member which covers the tip of the discharge pipe, is fixed in a freely reciprocating manner in an axial direction of the discharge pipe, and has an inclined surface on a main body side, gradually inclined upward toward a tip, so as to open or close the discharging port; and a biasing member for biasing the opening/closing member in a projection direction from the discharge pipe; and a waste powder recovery container detachably attached to the apparatus main body and provided with a recovery port, through which waste powder discharged from the component part is recovered, at an inclined surface on a container side, gradually inclined downward in an attachment direction to the image forming apparatus; wherein when the waste powder recovery container is installed in the image forming apparatus, the inclined surface on the container side presses the inclined surface on the side of the body, so as to move the opening/closing member, thereby opening the discharging port, so that a degraded developer is recovered to the waste powder recovery container through the recovery port.

Preferably, the component part constituting the process unit, through which the waste powder is discharged, includes: a developing device for circulating and moving a developer contained in the developer container while agitating the developer by conveying means, supplying the developer to a developer carrier, discarding a degraded developer from the discharging portion to the waste powder recovery container, and replenishing a fresh developer from a replenishing portion; and a cleaner for recovering a toner remaining at the surface of an image carrier; the waste powder recovery container being vertically bisected into a toner recovery chamber in an upper portion and a developer recovery chamber in a lower portion, wherein the developer recovery chamber has a greater rate of an inner space with respect to a height in comparison with the toner recovery chamber; the recovery port being formed at an inclined surface on a container side, which extends upward from the developer recovery chamber to be positioned at a side of the toner recovery chamber and is gradually inclined downward toward the side.

According to the present invention, when the waste powder recovery container is installed in the image forming apparatus, the inclined surfaces are brought into press-contact with each other, so that the discharging port and the recovery port can communicate with each other. As a result, the discharging portion does not project into the waste powder recovery container, and therefore, the flying waste powder cannot attach to the discharging portion. Thus, even when the waste powder recovery container is replaced with a new one, the waste powder attached to the discharging portion cannot fly thereabout, so that there arises no trouble in image forming processing due to the attachment of the waste powder to the process unit.

DESCRIPTION OF THE PREFERRED EMBODIMENTS

A description will be given below of preferred embodiments according to the present invention with reference to the attached drawings. In the description below, kinds, combinations, shapes, relative arrangements, and the like of components do not restrict the technical scope of the present invention, unless specifically stated. In addition, although terms indicating specific directions or positions (including "upper," "lower," "one end," and "the other end") are appropriately used, as required, the terms are used for the sake of easy understanding of the invention with reference to the attached drawings and do not restrict the technical scope of the present invention.

1. Configuration

Figure 1:
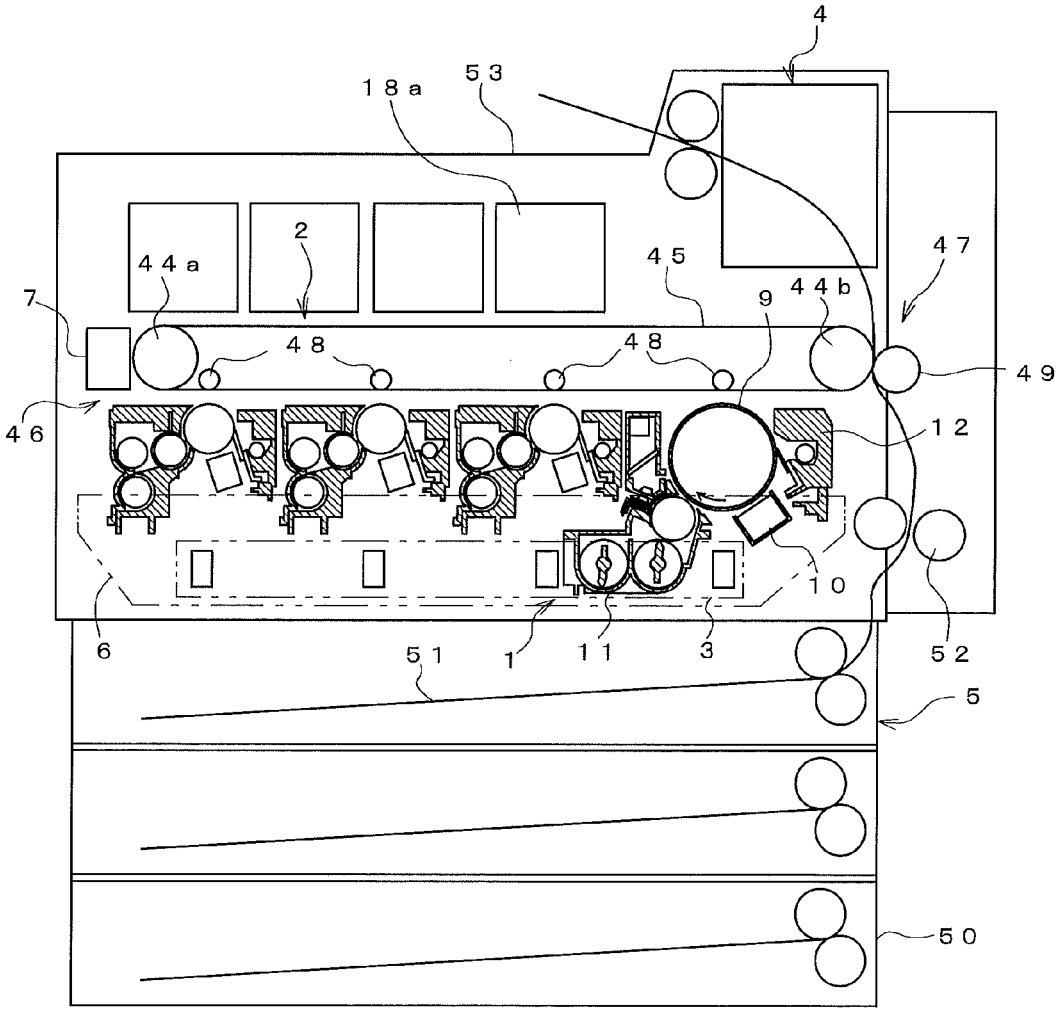
FIG. 1 is a front view schematically showing an image forming apparatus according to the present embodiment.
Figure 3:
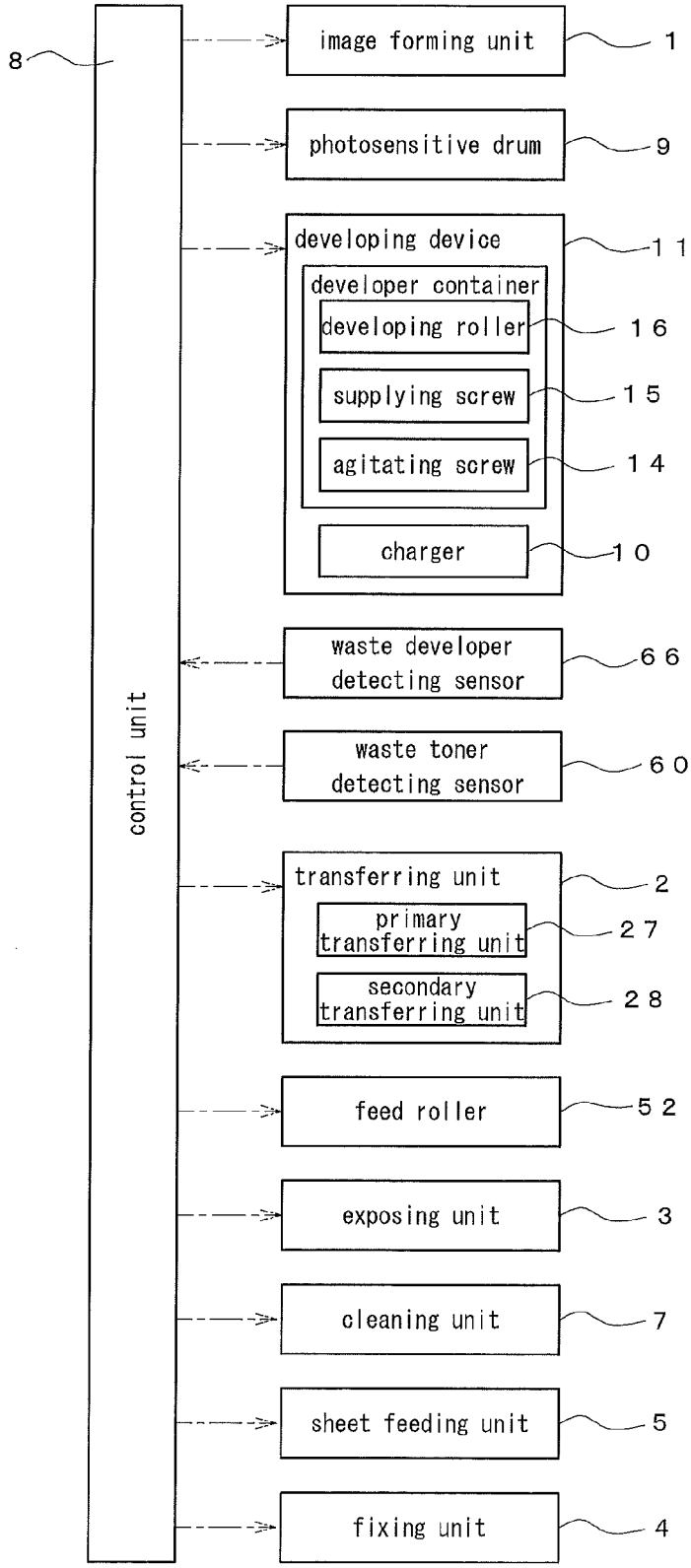
FIG. 3 is a block diagram showing the image forming apparatus according to the present embodiment.

FIG. 1 shows an image forming apparatus of a so-called trickle system, in particular, in which not only a toner but also a developer is replenished, among electrophotographic systems using a two-component developer. The image forming apparatus includes an image forming unit 1, a transferring unit 2, an exposing unit 3, a fixing unit 4, a sheet feeding unit 5, a waste powder recovery unit 6, a cleaning unit 7, a control unit 8 (see FIG. 3), and the like. In this case, the image forming apparatus may be any of a copying machine, a printer, a facsimile, and a composite machine compositely equipped with functions thereof.

(1-1. Image Forming Unit 1)

Four image forming units 1 are arranged along an intermediate transfer belt 45 in the transferring unit 2, to perform formation of images of yellow (Y), magenta (M), cyan (C), and black (Bk) colors from the left, so as to form a color image on the surface of the intermediate transfer belt 45. Each of the image forming units 1 includes a charger 10, a developing device 11, a cleaner 12, and the like around a photosensitive drum 9, as shown in FIG. 2.

The charger 10 makes a predetermined surface potential on the photosensitive drum 9. The surface potential forms an electrostatic latent image by exposure by the use of the exposing unit 3. Although a scorotron charger of a non-contact type is used as the charger 10 herein, a charger of a contact type such as a blade- or brush-like charger or a charging roller may be used.

Figure 2A:
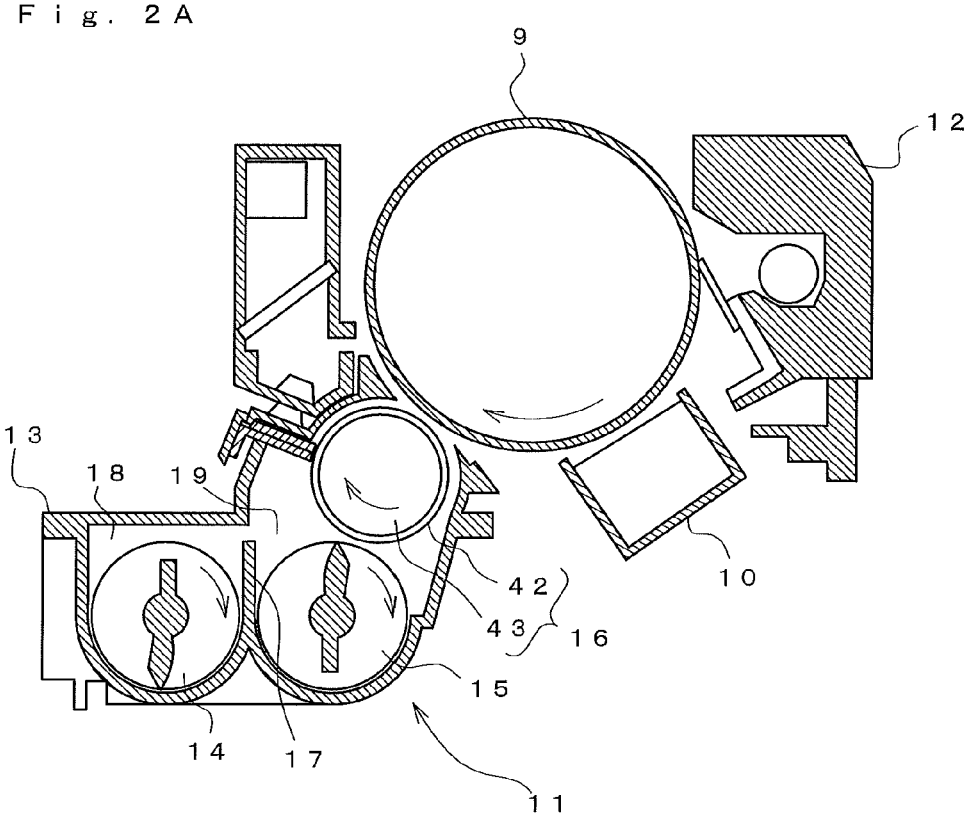
FIG. 2A is a front cross-sectional view schematically showing the image forming unit shown in FIG. 1.
Figure 2B:
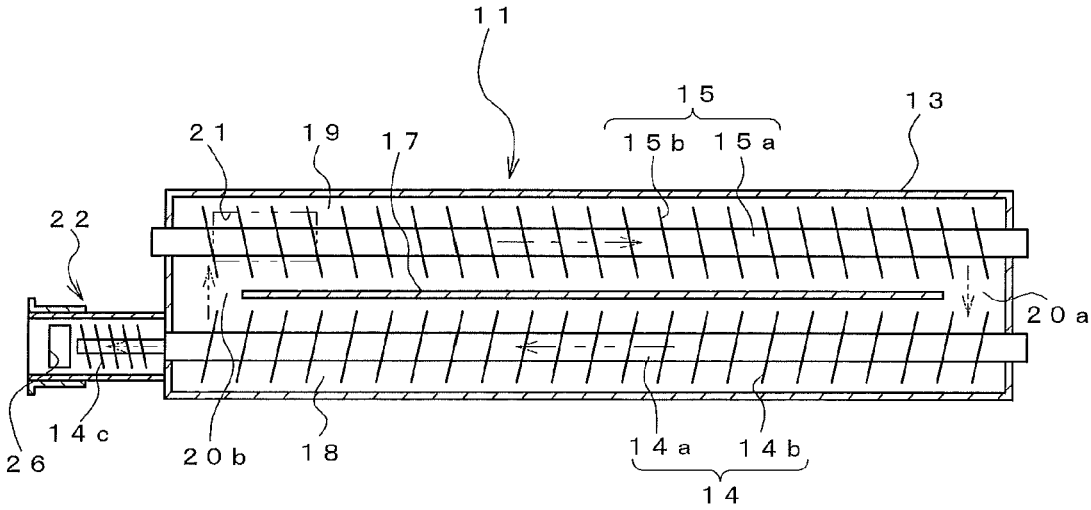
FIG. 2B is a plan cross-sectional view schematically showing a developing device in the image forming unit.

As shown in FIGS. 2A and 2B, the developing device 11 contains an agitating screw 14, a supplying screw 15, and a developing roller 16 inside a developer container 13.

As shown in FIG. 2B, the developer container 13 is formed into an elongated box extending from one end to the other end. The inside of the developer container 13 is bisected into a first storage portion 18 and a second storage portion 19 in a longitudinal direction by a first partition wall 17. Both ends of the first storage portion 18 and both ends of the second storage portion 19 communicate with each other via communicating portions 20*a* and 20*b*, respectively. The contained developer is designed to be circulated and moved while being agitated.

A developer replenishing port 21 is formed at one end of the second storage portion 19, that is, in the vicinity of the communicating portion 20*b*, and thus, is replenished with the developer from a corresponding developer replenishing storage portion 18*a* (see FIG. 1). In this case, a two-component developer incorporating a toner and a carrier is used as the developer. The developer may incorporate an additive. A developer discharging portion 22 is formed at one end of the first storage portion 18, that is, in the vicinity of the communicating portion 20*b*. The developer is appropriately discharged, so that a degraded carrier does not remain inside the developer container 13 for a long period of time.

The developer discharging portion 22 includes a discharge pipe 23, an opening/closing member 24, and a coil spring 25 for biasing the opening/closing member 24 toward a closure position, as shown in FIGS. 10A to 12B.

Figure 12A:
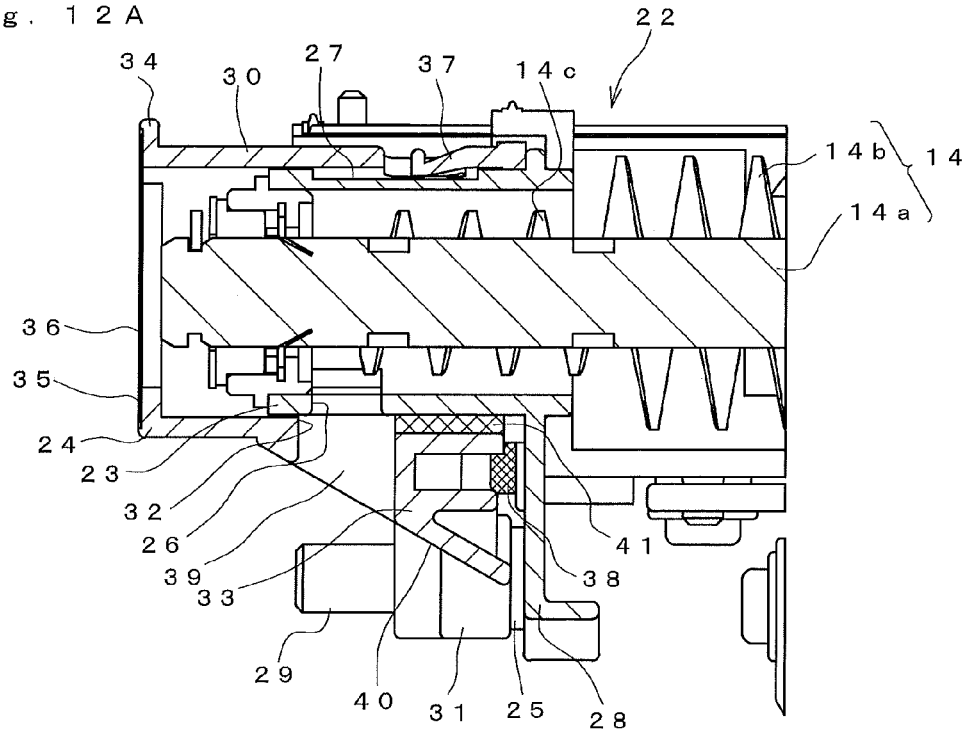
FIG. 12A is a cross-sectional view showing the developer discharging portion having a developer discharging port in an open state.
Figure 12B:
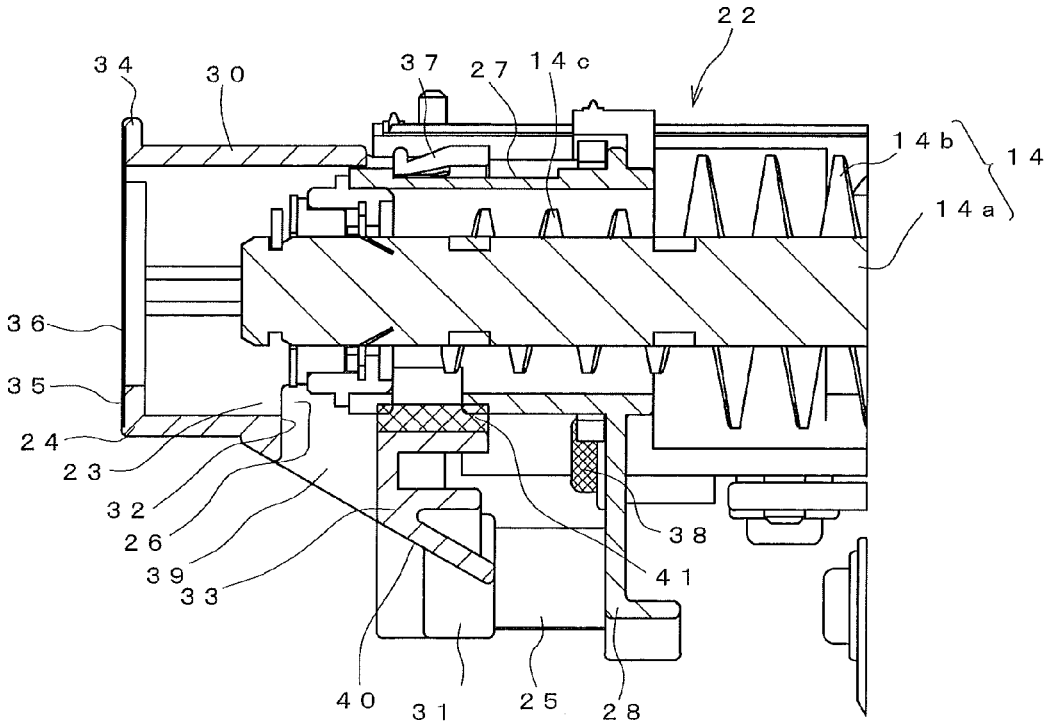
FIG. 12B is a cross-sectional view showing the developer discharging portion having the developer discharging port in a closed state.

The discharge pipe 23 has a developer discharging port 26 at the lower surface thereof whereas a guide recess 27 at the upper surface thereof, as shown in FIGS. 12A and 12B. Moreover, the discharge pipe 23 has a substantially triangular support plate 28 in a lower portion at the rear end thereof. The support plate 28 has two projections 29 for fixing the coil spring 25 which resiliently supports the opening/closing member 24.

The opening/closing member 24 includes a cylindrical portion 30 covering the tip of the discharge pipe 23, two spring receivers 31 extending from the cylindrical portion 30, and an opening/closing portion 33 provided with an opening/closing port 32 for opening or closing the developer discharging port 26.

The cylindrical portion 30 has a flange 34 formed at the tip thereof. The flange 34 projects upward at the upper portion thereof. The flange 34 has a step 35 formed at the end thereof along an outer edge, to which a seal plate 36 is attached. The upper rear surface of the cylindrical portion 30 is cut in a substantially U shape, thereby forming a tongue piece 37 projecting forward to the tip. The tongue piece 37 is bent downward at the tip thereof, is positioned at the tip thereof inside the guide recess 27 of the discharge pipe 23, and thus, restricts a range of reciprocating motion of the opening/closing member 24 with respect to the discharge pipe 23. A seal member 38 is arranged at the rear end of the cylindrical portion 30, thereby sealing a space defined between the discharge pipe 23 and the support plate 28.

The spring receiver 31 is formed into a cylindrical shape, and has the coil spring 25 housed therein. The spring receiver 31 is disposed in such a manner as to extend from the cylindrical portion 30. Therefore, in comparison with the case where the coil spring 25 is disposed in the cylindrical portion 30, the axial dimension of the cylindrical portion 30 can be more remarkably suppressed. The spring receiver 31 may be located apart from the cylindrical portion 30 at a position at which it cannot interfere with the opening/closing portion 33. The coil spring 25 enables the opening/closing member 24 to project in such a manner as to be freely pushed.

At the opening/closing portion 33, a passage 39 extends downward from the opening/closing port 32 for opening/closing the developer discharging port 26 formed on the discharge pipe 23. The lower end of the passage 39 opens to an inclined surface 40 formed on a main body side, gradually inclined upward toward the front. The opening/closing portion 33 has a closed portion 41 such as urethane at an upper rear end constituting the opening/closing port 32. The closed portion 41 moves the seal member 38 to a closure position in a projection direction so as to close the developer discharging port 26 of the discharge pipe 23.

As shown in FIG. 2B, the agitating screw 14 is disposed in the first storage portion 18, and includes a first spiral blade 14*b* extending from one end to the other end around a rotary shaft 14*a* and a second blade 14*c* wound reversely to the first blade 14*b* at the other end. When the agitating screw 14 is rotationally driven, the first blade 14*b* agitates the developer while conveying it from the communicating portion 20*a* to the communicating portion 20*b*, and further, the second blade 14*c* applies a predetermined resistant pressure onto the developer flowing to the developer discharging port 26. As a result, only an excess developer is discharged through the developer discharging port 26.

The supplying screw 15 is disposed in the second storage portion 19, and includes a spiral blade 15*b* around a rotary shaft 15*a*. When the supplying screw 15 is rotationally driven, the supplying screw 15 conveys the developer from the communicating portion 20*b* to the communicating portion 20*a*, and further, supplies the developer to the developing roller 16.

The developing roller 16 houses a plurality of permanent magnets 43 inside a cylindrical sleeve 42 (in this case, five permanent magnets S2, N2, S1, N1, and S3 are arranged clockwise in this order), as shown in FIG. 2A. The sleeve 42 is designed to be rotated in a direction indicated by an arrow in FIG. 2A by a sleeve drive member (not shown).

Figure 13:
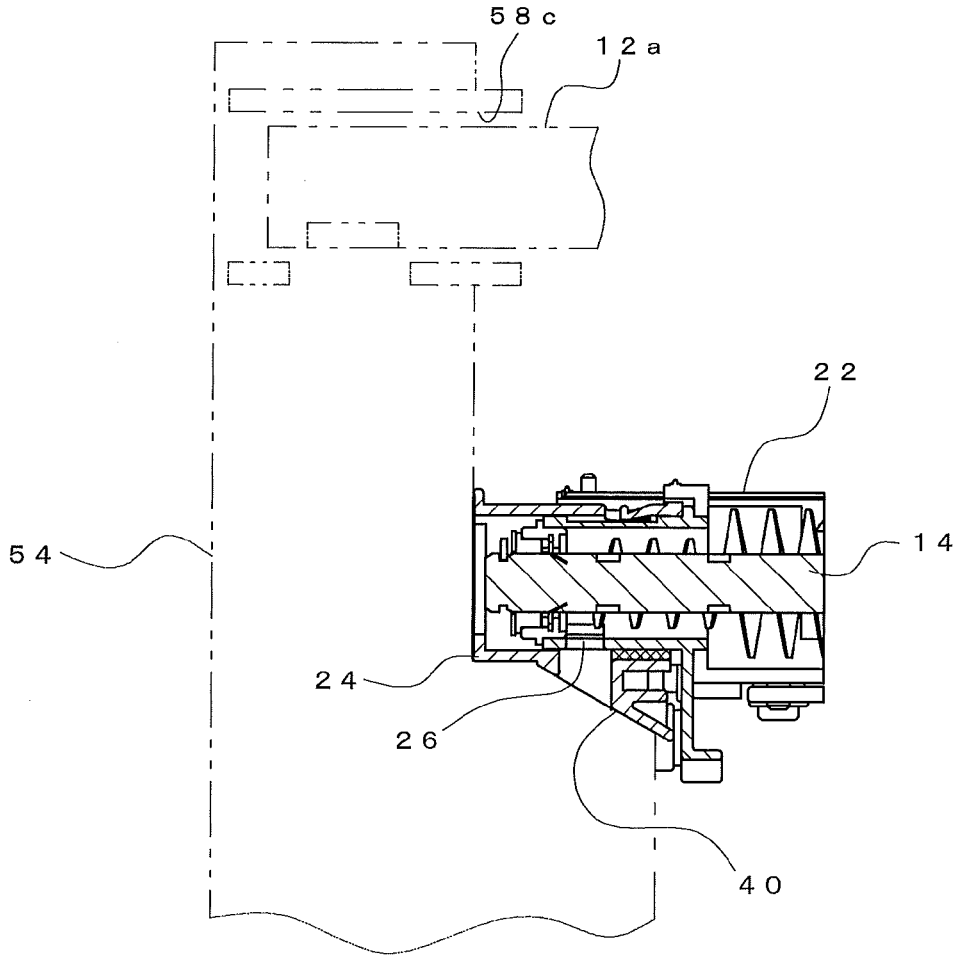
FIG. 13 is an explanatory view of a positional relationship between a toner discharging portion and the developer discharging portion.

The cleaner 12 recovers the toner remaining on the surface of the photosensitive drum 9 after the toner is transferred onto the intermediate transfer belt 45 from the surface of the photosensitive drum 9. As shown in FIG. 13, the cleaner 12 includes a toner discharging portion 12*a* for discarding the recovered toner. The toner discharging portion 12*a* is formed into a cylindrical shape, and incorporates therein a waste screw (not shown). The toner discharging portion 12*a* is inserted into toner recovery ports 58*a* to 58*d* formed at a waste powder recovery container 54, which is installed in the image forming apparatus, as described below. A waste toner remaining inside the cleaner 12 is discarded to a toner recovery chamber 56 by rotating the waste screw. Note that the cleaner 12 is not limited to a blade, but other cleaning members (e.g., a fixing brush, a rotary brush, and a roller) may be used. In addition, a plurality of cleaners 12 may be used together, or the cleaner 12 may adopt a cleaner-less system in which the developing device 11 may recover a not-transferred toner in place of the cleaner 12.

(1-2. Transferring Unit 2)

As shown in FIG. 1, the transferring unit 2 is configured such that the intermediate transfer belt 45 is stretched across a pair of support rollers 44*a* and 44*b*, and then, is moved around by a drive member (not shown) in a direction indicated by an arrow. The transferring unit 2 includes a primary transferring unit 46 and a secondary transferring unit 47. The primary transferring unit 46 includes primary transferring rollers 48 facing the photosensitive drum 9 while holding the intermediate transfer belt 45 therebetween. The primary transferring roller 48 applies a positive voltage to the back surface of the intermediate transfer belt 45. In the meantime, the secondary transferring unit 47 includes a secondary transferring roller 49 facing the support roller 44*b*. The secondary transferring roller 49 applies a positive voltage to the back surface of the intermediate transfer belt 45. A toner image transferred onto the intermediate transfer belt 45 is transferred onto a recording medium 51 (e.g., a sheet of paper).

(1-3. Exposing Unit 3)

The exposing unit 3 irradiates the photosensitive drum 9 with a laser beam, thereby forming an electrostatic latent image corresponding to image data read by a scanner (not shown). The exposing unit 3 may be exemplified by a laser, a light emitting diode, or the like.

(1-4. Fixing Unit 4)

The fixing unit 4 rotatably supports a fixing roller and a pressurizing roller (neither shown). The fixing roller is made of a conductive material, is rotatably driven by a motor (not shown) and is inductively heated by an exciting coil (not shown). The pressurizing roller is brought into press-contact with the fixing roller, and the recording medium 51 is held between the pressurizing roller and the fixing roller. Accordingly, the toner transferred in the transferring unit 2 can be fixed onto the recording medium 51.

(1-5. Sheet Feeding Unit 5)

The sheet feeding unit 5 sequentially feeds the recording mediums 51, which are stacked in a cassette 50, to the secondary transferring unit 47 via a plurality of feed rollers 52. Thereafter, the toner image is transferred onto the recording medium 51 in the secondary transferring unit 47. The transferred toner image is then fixed to the recording medium 51 in the fixing unit 4. Finally, the recording medium 51 is discharged onto a discharge tray 53.

(1-6. Waste Powder Recovery Unit 6)

Figure 4:
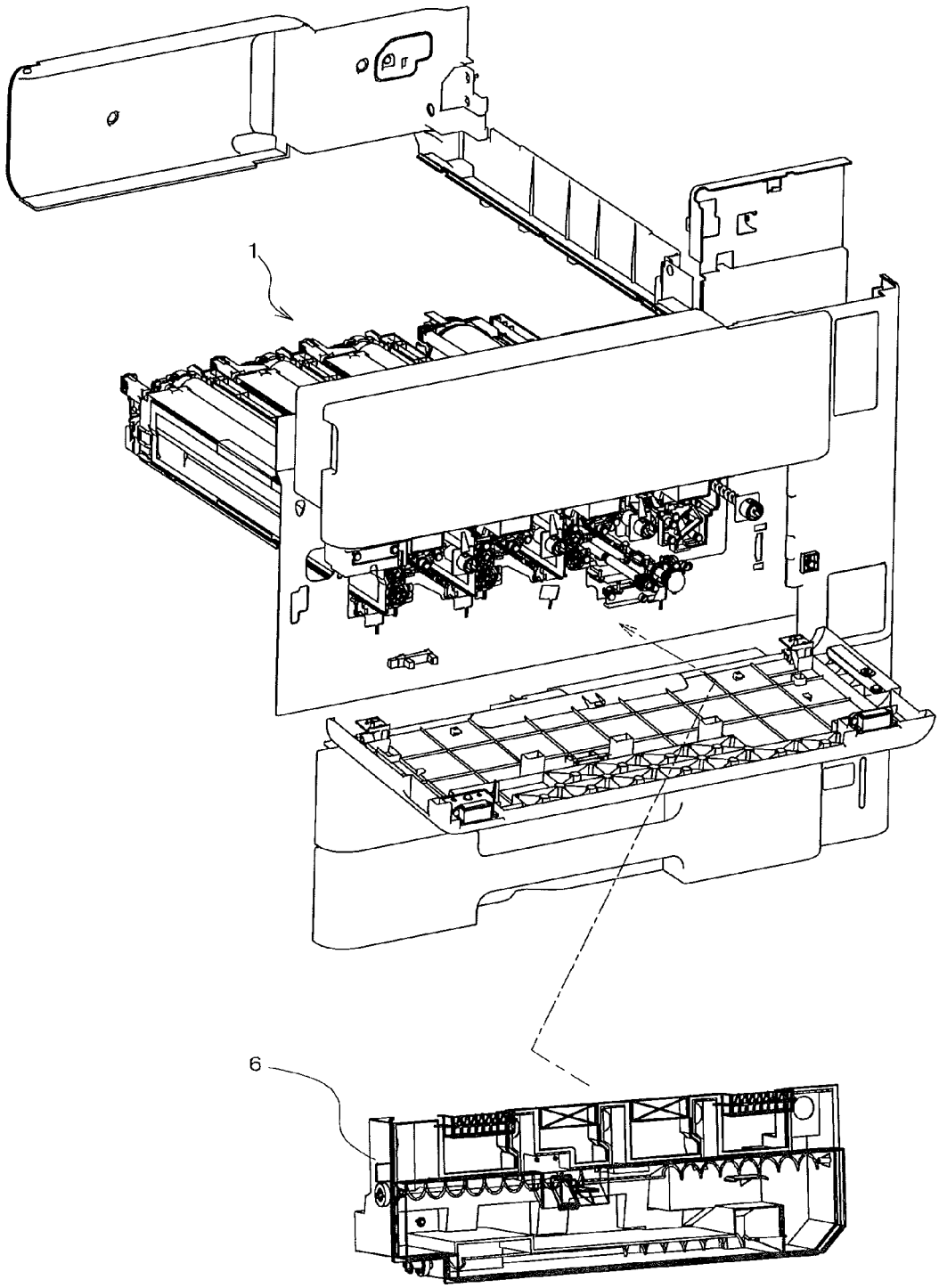
FIG. 4 is a partial perspective view showing a waste powder recovery container detached from the image forming apparatus according to the present embodiment.
Figure 5:
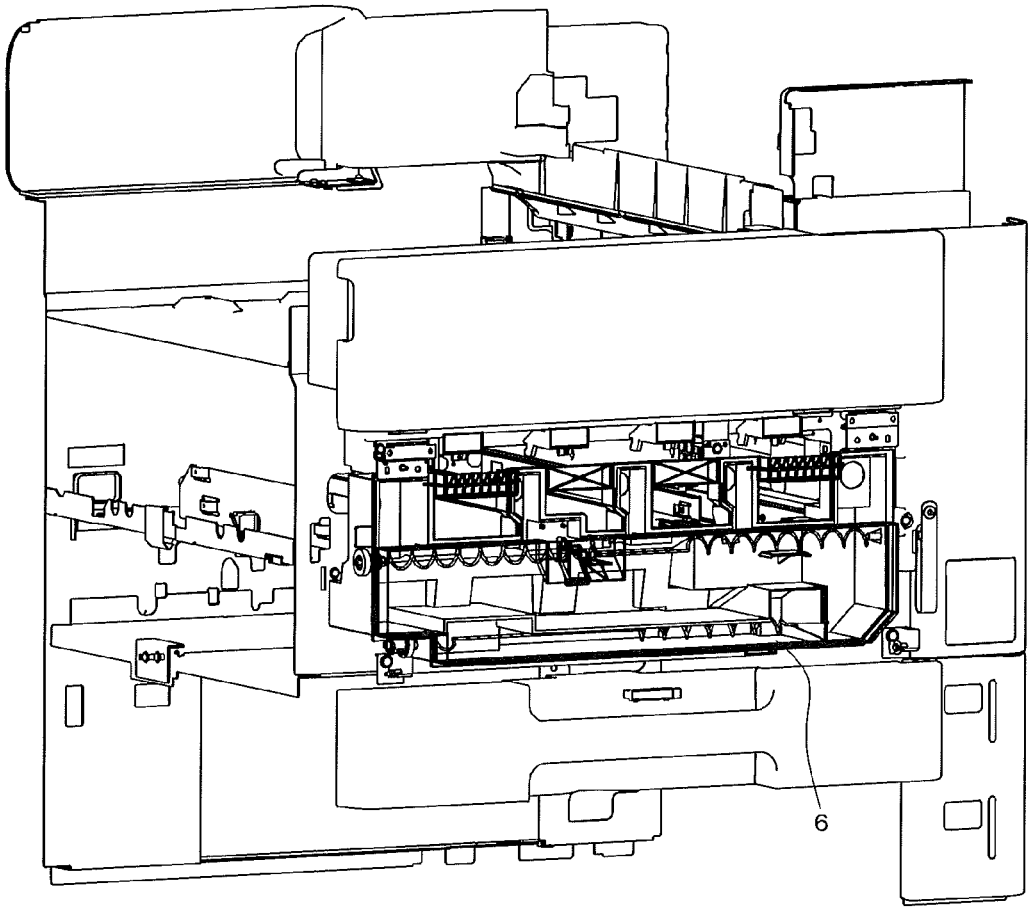
FIG. 5 is a partial perspective view showing the waste powder recovery container attached to the image forming apparatus according to the present embodiment.
Figure 6A:
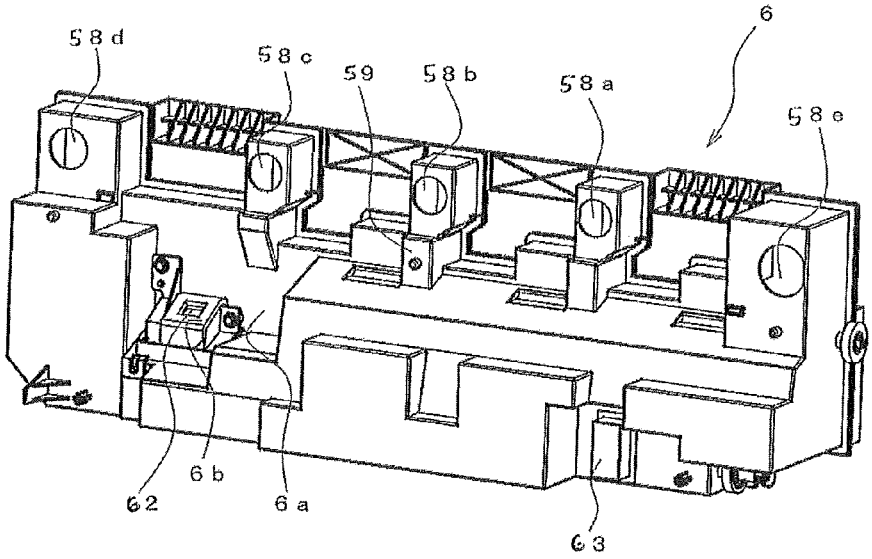
FIG. 6A is a perspective view showing the waste powder recovery container shown in FIGS. 5 and 6.
Figure 6B:
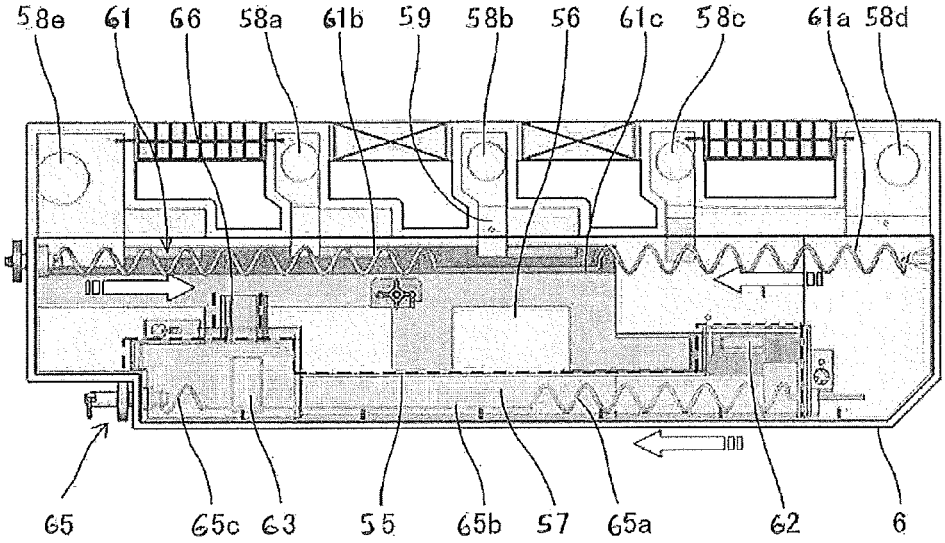
FIG. 6B is a front cross-sectional view showing the waste powder recovery container, as viewed from an opposite side.

The waste powder recovery unit 6 includes the waste powder recovery container 54. As shown in FIGS. 4 and 5, the waste powder recovery container 54 is detachably attached in a lower space in the image forming unit 1. As shown in FIG. 6B, the inner space is vertically bisected via a second partition wall 55. A defined upper space serves as the toner recovery chamber 56 whereas a lower space serves as a developer recovery chamber 57.

The toner recovery chamber 56 is provided with toner recovery ports 58*a*, 58*b*, 58*c*, and 58*d* to be connected to the image forming units 1 for the yellow (Y), magenta (M), cyan (C), and black (Bk) colors and a toner recovery port 58*e*, through which the residual toner on the intermediate transfer belt 45 recovered by the cleaning unit 7 is recovered. All of the toner recovery ports 58*a*, 58*b*, 58*c*, 58*d*, and 58*e* communicate with the toner recovery chamber 56.

Moreover, the toner recovery chamber 56 is provided with a first detector 59 which has translucency and projects sideways. A waste toner detecting sensor 60 consisting of a light emitting element and a light receiving element is adapted to detect, at both side surfaces facing a projecting portion, whether or not the developer inside the first detector 59 is in a "near-full" state. In other words, when the toner can only be recovered into the toner recovery chamber 56 in a predetermined remaining quantity, the first detector 59 cannot transmit the light emitted from the light emitting element, so that the "near-full" state can be detected. The term "near-full" refers to a predetermined quantity (90% of the capacity) before reaching a full state.

Figure 8A:
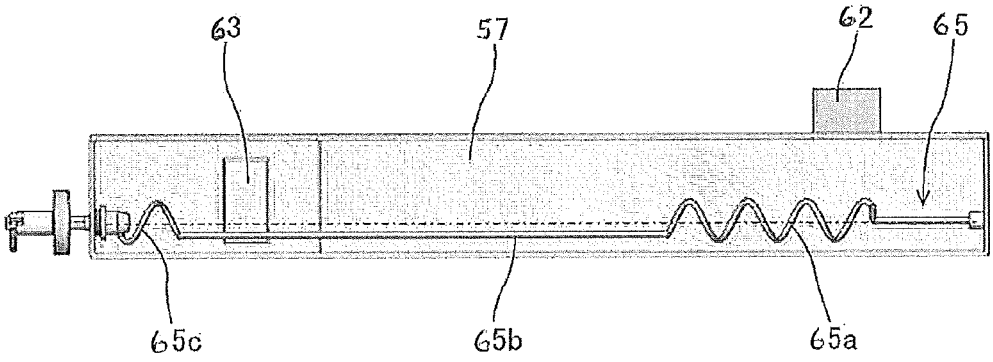
FIG. 8A is a cross-sectional view schematically showing a developer recovery chamber in the waste powder recovery container.

Furthermore, a toner agitating coil 61 formed by bending a wire rod is housed inside the toner recovery chamber 56, as shown in FIG. 8A. The toner agitating coil 61 is rotatably supported at both ends thereof through both end walls of the toner recovery chamber 56. A first spiral portion 61*a* and a second spiral portion 61*b* are formed at both ends of the toner agitating coil 61 inward of the supported portions, respectively. The first spiral portion 61*a* and the second spiral portion 61*b* are wound reversely to each other. A straight portion 61*c* displaced from the rotational center of the toner agitating coil 61 is formed between the first spiral portion 61*a* and the second spiral portion 61*b*. The toner agitating coil 61 is rotated in a direction in which the toner is conveyed toward the straight portion 61*c* by the first spiral portion 61*a* and the second spiral portion 61*b*. The straight portion 61*c* disperses in a widthwise direction the toner conveyed by the first spiral portion 61*a* and the second spiral portion 61*b*.

In contrast, the developer recovery chamber 57 is provided with a developer recovery port 62 connected to the opening/closing port 32 formed in the image forming unit 1 for the black (Bk) color. As shown in FIG. 6A, the developer recovery port 62 is opened to an inclined surface 64 on the container side formed on a recess 63 formed at the side surface of the waste powder recovery container 54.

On a side portion of the developer recovery chamber 57, there is disposed a second detector 65, which has translucency and projects to the side. Whether or not the developer inside the second detector 65 is in a "near-full" state is detected by a waste developer detecting sensor 66 including a light emitting element and a light receiving element through both opposing side surfaces of the projecting portion. In this case, a time point where a light beam emitted from the light emitting element and received by the light receiving element is no longer received by the light receiving element is the "near-full" state.

Moreover, a developer agitating coil 67 formed by bending a wire rod is housed inside the developer recovery chamber 57, like the toner agitating coil 61. The developer agitating coil 67 is rotatably supported at both ends thereof via both end walls of the developer containing chamber, to be rotated by a drive member (not shown). The developer agitating coil 67 includes a first spiral portion 67*a* at one end thereof positioned in the vicinity of the developer recovery port 62, a straight portion 67*b* extending toward the other end thereof from the first spiral portion 67*a*, and a second spiral portion 67*c* formed at the other end and wound reversely to the first spiral portion 67*a*. The first spiral portion 67*a* conveys the developer toward the other end while agitating the developer recovered inside the developer recovery chamber 57 through the developer recovery port 62. The straight portion 67*b* is displaced from the rotational center of the developer agitating coil 67. When the developer agitating coil 67 is rotated, the developer conveyed by the first spiral portion 67*a* is dispersed in the widthwise direction by the straight portion 67*b*. The second spiral portion 67*c* is located in the vicinity of a bearing portion rotatably supported on the other end wall of the developer recovery chamber. The second spiral portion 67*c* is rotated, thereby alleviating a pressure of the developer acting on the bearing portion. As a result, it is possible to prevent any leakage of the developer from the bearing portion or any interference with the rotation of the developer agitating coil 67.

Figure 7A:
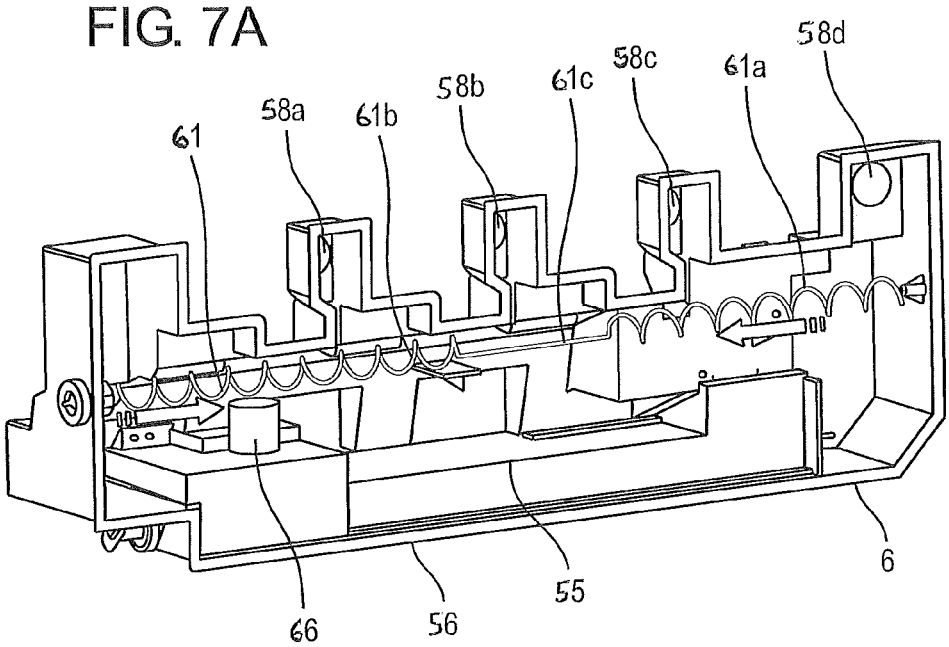
FIG. 7A is a cross-sectional perspective view showing the waste powder recovery container in FIG. 6A, as viewed from an opposite direction.
Figure 7B:
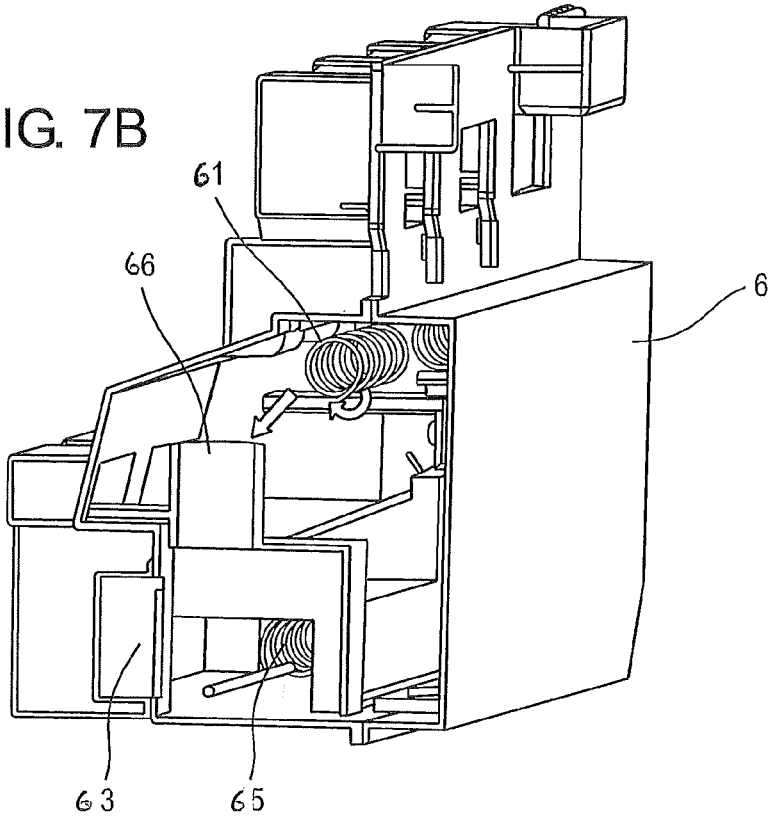
FIG. 7B is a cross-sectional perspective view showing the waste powder recovery container in FIG. 6A, as viewed from an end.

As shown in FIGS. 7A and 7B, the toner recovery chamber 56 and the developer recovery chamber 57 communicate with each other via a cylindrical portion 68 formed on the second partition wall 55. The cylindrical portion 68 is formed at an end opposite to the developer recovery port 62, and projects toward the toner recovery chamber 56. The capacity of each of the toner recovery chamber 56 and the developer recovery chamber 57 is determined based on experiments, experimental values, or the like, such that the toner recovery chamber 56 first comes to the "near-full" state, and then, the developer recovery chamber 57 comes to the "near-full" state. Therefore, when the toner recovery chamber 56 is in the "near-full" state before it is full ("full" state), the toner remaining inside the toner recovery chamber 56 flows down into the developer recovery chamber 57, which still has room for a recovery space, through the cylindrical portion 68.

In the above-described embodiment, the toner agitating coil 61 and the developer agitating coil 67 disposed in the waste powder recovery container 54 can be inexpensively and easily fabricated only by bending the wire rods. Note that each of the coils may be constituted by a screw having a spiral blade disposed on a rotary shaft. Specifically, a spiral blade and a plate-like paddle may be disposed on a rotary shaft, the blade functioning as the spiral portion of the developer agitating coil whereas the paddle functioning as the straight portion.

(1-7. Cleaning Unit 7)

The cleaning unit 7 can be brought into or out of contact with the intermediate transfer belt 45. When the cleaning unit 7 approaches the intermediate transfer belt 45, it recovers the toner remaining on the intermediate transfer belt 45 so as to clean the intermediate transfer belt 45.

(1-8. Control Unit 8)

The control unit 8 detects the recovery state, that is, the "near-full" state of the toner or developer in the toner recovery chamber 56 or the developer recovery chamber 57 in the waste powder recovery container 54 based on an ON signal inputted from the waste toner detecting sensor 60 or the waste developer detecting sensor 66, and then, predicts the "full" state based on a predetermined count, as described below.

2. Operation

Next, a description will be given of an operation of the image forming apparatus 1 having the above-described configuration.

Color print data obtained by reading an image by an image reading unit (not shown) or image data inputted from a personal computer or the like is subjected to a predetermined signal processing in the control unit 8, to be then inputted into the image forming apparatus 1. The image forming apparatus 1 modulates a laser beam based on the inputted image data, and then, projects the laser beam on the photosensitive drum 9, so as to form a latent image.

In each of the image forming units 1 for supplying the color toners, the waste toner is recovered from the photosensitive drum 9 in the cleaner 12. The waste toner recovered in the cleaner 12 is recovered to the toner recovery chamber 56 through the toner recovery ports 58*a* to 58*e* in the waste powder recovery container 54.

In the image forming unit 1 for supplying the black (Bk) toner, the developer is replenished into the first storage portion 18 in the developer container 13. The replenished developer is sequentially conveyed in an axial direction by the first blade 14*b* by the rotation of the agitating screw 14. The developer conveyed at one end receives a reversal pressure (i.e., a resistant pressure) by the second blade 14*c*. An excess developer (i.e., a waste developer) having a pressure greater than the resistant pressure is discharged to the developer recovery chamber 57 in the waste powder recovery container 54 through the opening/closing port 32 whereas the residual developer is conveyed to the second storage portion 19 through the second communicating portion 20*b*. In the second storage portion 19, the developer is supplied to the developing roller 16 while being agitated by the supplying screw 15, and then, is returned to the first storage portion 18 through the first communicating portion 20*a*, to be circulated therein.

In the waste powder recovery container 54, from the start to the end of the image forming processing, the toner agitating coil 61 is rotated in the toner recovery chamber 56 by the motor (not shown), whereas the developer agitating coil 67 is rotated in the developer recovery chamber 57 by the motor (not shown).

The toner recovered through the toner recovery ports 58*a* to 58*e* is accumulated in the toner recovery chamber 56. When the accumulated toner reaches the rotational region of the toner agitating coil 61, the toner is conveyed to the center by the first spiral portion 61*a* and the second spiral portion 61*b* while being agitated. At the center, the toner is leveled off in a widthwise direction by the straight portion 61*c*. The first detector 59 detects whether or not the toner in the toner recovery chamber 56 is in the "near-full" state.

Figure 8B:
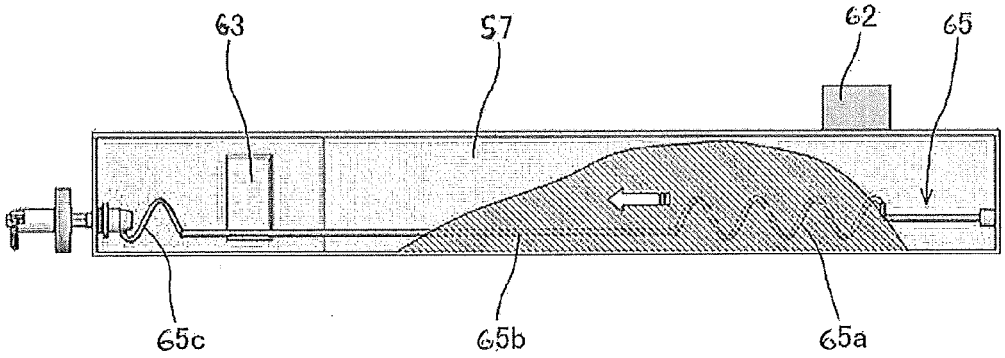
FIG. 8B is a view showing a developer recovered through a developer recovery port being conveyed in a longitudinal direction by a first spiral portion.
Figure 8C:
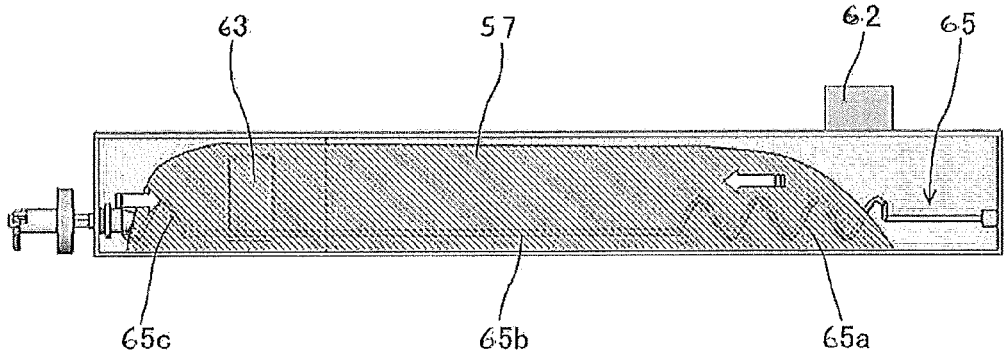
FIG. 8C is a view showing the developer conveyed to a second spiral portion by the first spiral portion.
Figure 9A:
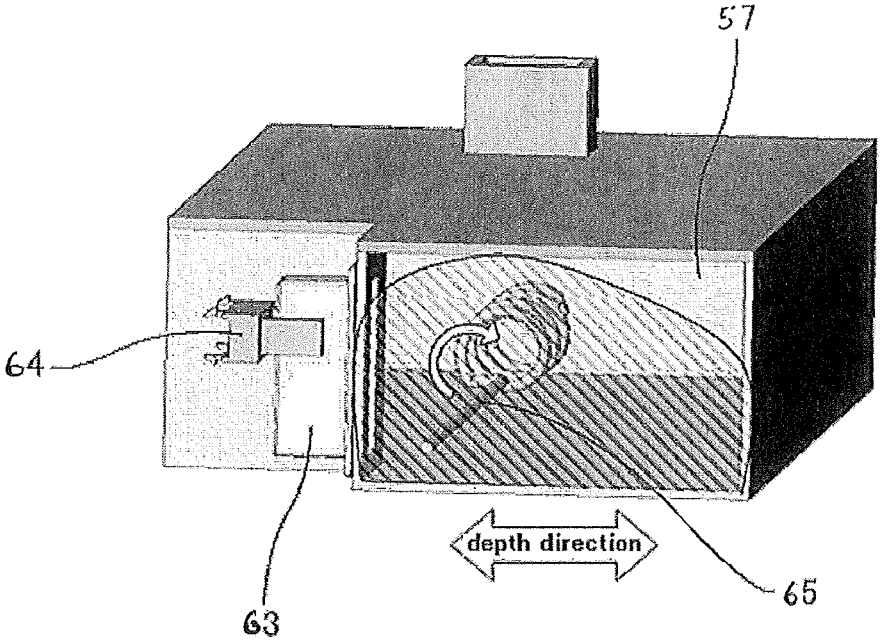
FIG. 9A is a perspective view showing the developer recovery chamber in the waste powder recovery container, in which the developer is dispersed in a widthwise direction by a straight portion, as viewed from the end.
Figure 9B:
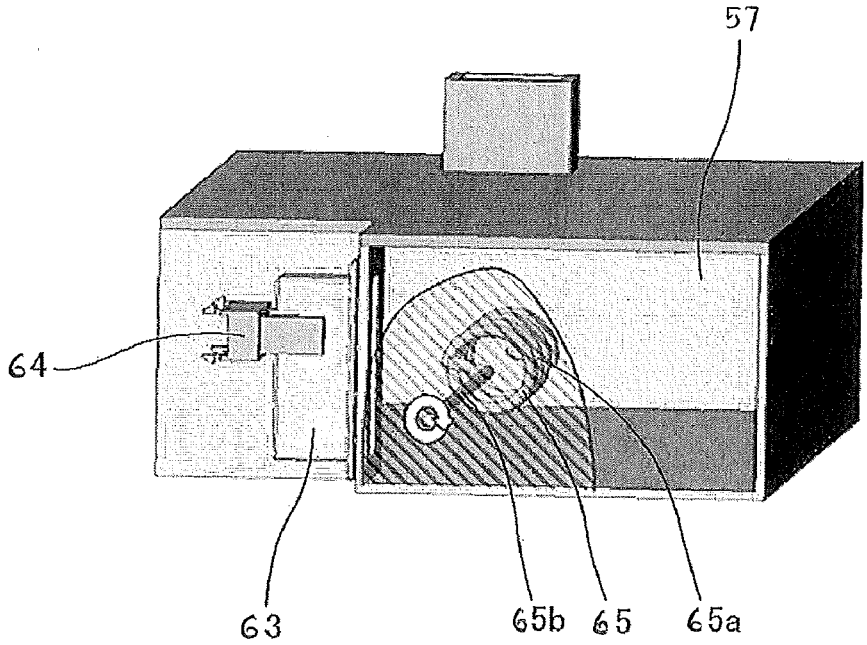
FIG. 9B is a view showing the developer before being dispersed in the widthwise direction.
Figure 10A:
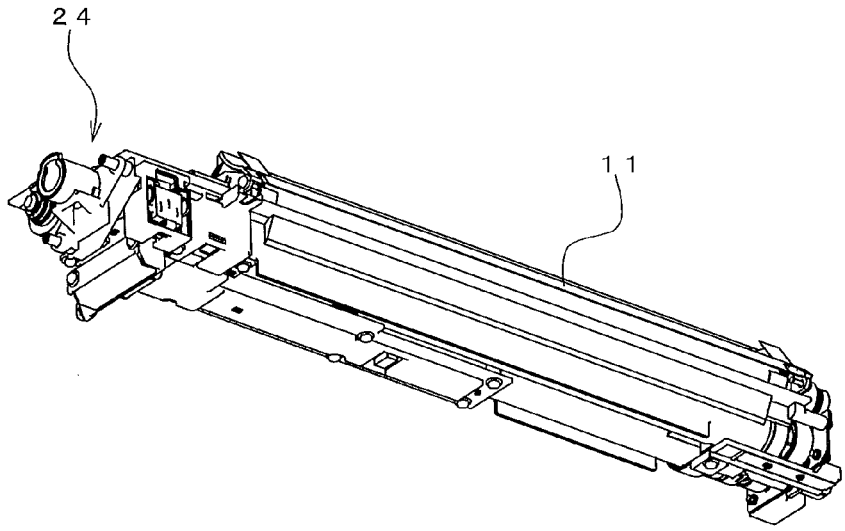
FIG. 10A is a perspective view showing the developing device, as viewed from below.
Figure 10B:
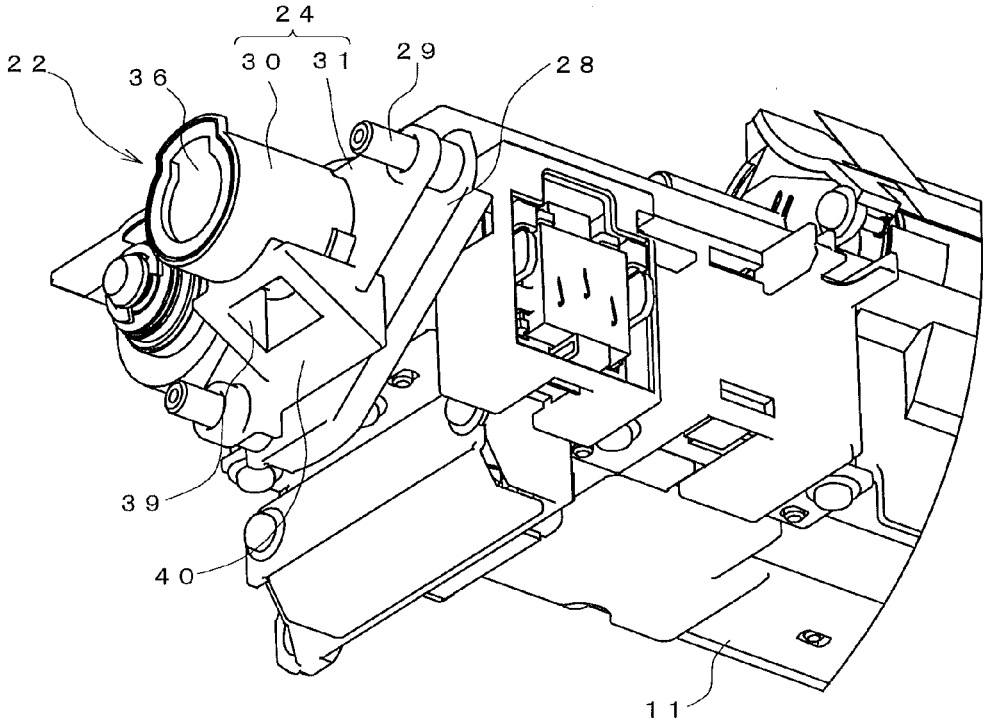
FIG. 10B is a partially enlarged view showing a developer discharging portion in the developing device.
Figure 11:
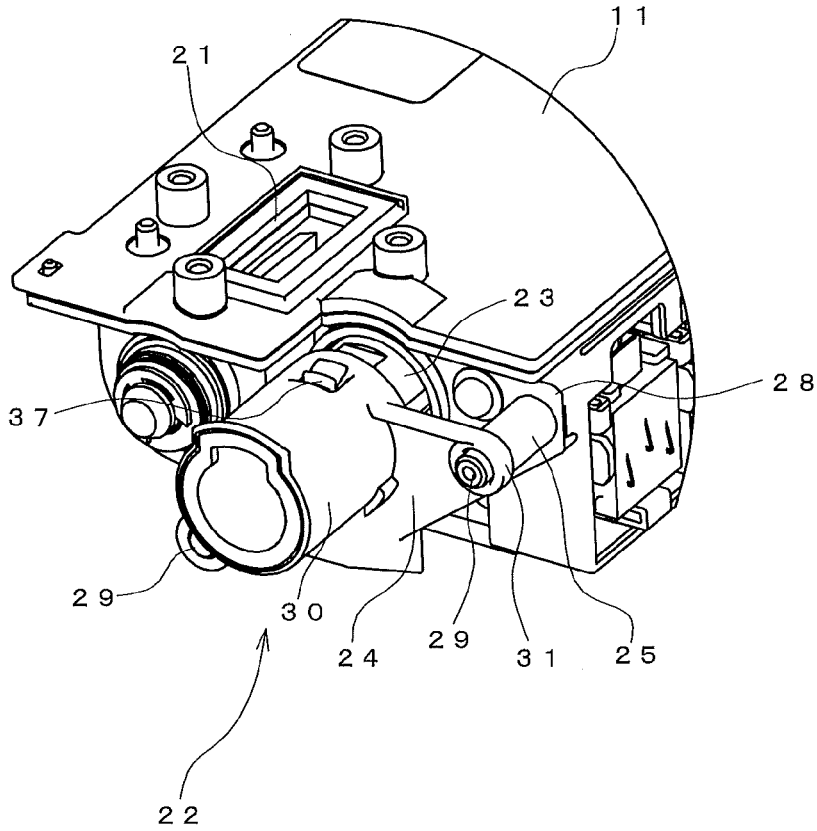
FIG. 11 is a perspective view showing the developer discharging portion, as viewed from above.

In contrast, in the developer recovery chamber 57, when the developer agitating coil 67 is rotated, the developer recovered through the developer recovery port 62 is conveyed in a longitudinal direction by the first spiral portion 51*a* while being agitated, as shown in FIG. 8B. When the developer reaches the straight portion 51*b* formed eccentrically from the rotational center, the developer is dispersed in the widthwise direction from a state shown in FIG. 9B to a state shown in FIG. 9A. Therefore, even the developer recovery chamber 57 having a width greater than a height can level off the waste developer in the widthwise direction without any unevenness. When the waste developer reaches the straight portion 51*b*, the waste developer is further conveyed to the second spiral portion 51*c* with a thrust from the first spiral portion 51*a* while also being dispersed in the widthwise direction. Since the second spiral portion 51*c* is wound reversely to the first spiral portion 51*a*, a reverse force is exerted on the developer. Consequently, the pressure of the developer acting on the bearing portion is alleviated, as shown in FIG. 8C. Thus, it is possible to prevent any malfunction that the developer leaks outside through the bearing portion or that the developer degrades the rotation support state at the bearing portion to induce insufficient rotation of the developer agitating coil 67.

Thereafter, when the toner recovery chamber 56 is in the "near-full" state, the waste toner detecting sensor 60 detects this state, and then transmits a detection signal to the control unit 8. The control unit 8 determines the "near-full" state based on the detection signal, thereby sending a first notice. Thereafter, when the toner is further recovered in the toner recovery chamber 56, the toner flows down to the developer recovery chamber 57 through the cylindrical portion 68.

When the waste powder recovery container 54 comes to the "near-full" state with the developer recovered through the developer recovery port 62 and the toner flowing down from the toner recovery chamber 56 through the cylindrical portion 68, the waste developer detecting sensor 66 detects that the waste powder recovery container 54 is in the "near-full" state, and then transmits a detection signal to the control unit 8. The control unit 8 determines the "near-full" state based on the detection signal, thereby sending a second notice. In this manner, a user can know that the residual capacity inside the waste powder recovery container 54 has further become small after the first notice, and that the waste powder recovery container 54 soon needs to be replaced with a new one. In this case, the control unit 8 may count a time from the first notice to the second notice or the number of times of image formation so as to predict the replacement time of the waste powder recovery container 54. Indication of a prediction result on a display (not shown) enables the user to accurately find the replacement time of the waste powder recovery container 54 for the sake of convenience before the user forcibly stops the apparatus.

As described above, when the waste powder recovery container 54 comes to the "full" state or near the "full" state, the waste powder recovery container 54 is detached, and is then replaced with a new waste powder recovery container 54.

When the waste powder recovery container 54 is detached, the opening/closing member 24 cannot be supported by the inclined surface 64 on the container side in press-contact with the inclined surface 40 on the main body side, and thus, it is moved to the projection position, that is, the closure position shown in FIG. 12B by the biasing force of the coil spring 25. In this manner, the developer discharging port 26 of the discharge pipe 23, which is opened by the opening/closing port 32, is closed by the closed portion 41 of the opening/closing member 24.

When a new waste powder recovery container 54 is attached, the inclined surface 64 on the container side presses the inclined surface 40 on the main body side formed at the opening/closing member 24, which is then moved to a push-in position, that is, an open position against the biasing force of the coil spring 25. As a result, the developer discharging port 26 formed on the discharge pipe 23 is opened.

In the state in which the waste powder recovery container 54 is attached in the above-described manner, the developing device 11 communicates with the waste powder recovery container 54 while the inclined surface 64 on the container side is brought into press-contact with the inclined surface 40 on the main body side, as shown in FIGS. 12A and 13. Consequently, the developer discharging portion 22 in the developing device 11 does not intrude into the waste powder recovery container 54. Therefore, the waste toner does not attach to the developer discharging portion 22 in the developing device 11 even if the waste toner is discharged from the toner discharging portion 12*a* of the cleaner 12 inserted into the upper space in the waste powder recovery container 54 through the toner recovery ports 58*a* to 58*e*, and the waste toner flies inside the inner space. In other words, even when a new waste powder recovery container 54 is attached next time, a replacement work can be stably performed since the waste toner cannot attach to the developer discharging portion 22 in the developing device 11.

3. Other Embodiments

The present invention is not limited to the configuration exemplified in the above-described embodiment, but may be variously modified and altered.

For example, although a position, at which the developer discharging portion 22 in the developing device 11 that discharges the developer is connected to the waste powder recovery container 54, is lower than a position, at which the toner discharging portion in the cleaner 12 is connected to the waste powder recovery container 54 in the above-described embodiment, the positional relationship between the both may be reversed or may be approximately the same height. That is, the discharging positions of the toner and the developer may be provided at any position in the waste powder recovery container 54.

Alternatively, although the waste powder recovery container 54 is detachably attached in the front side of the image forming apparatus in the above-described embodiment, it may be detachably attached at the side or the back of the image forming apparatus.

What is claimed is:

1. A waste powder recovery container detachably attached to an image forming apparatus and provided with a recovery port, through which waste powder discharged from a component part constituting a process unit is recovered, the waste powder recovery container comprising: an inclined surface on the container side, which is inclined downward in an attachment direction to the image forming apparatus and has the recovery port formed thereat, wherein the inclined surface on the container side moves an opening/closing member disposed in a discharging portion formed at the component part constituting the process unit by pushing an inclined surface on a main body side formed at the opening/closing member, thereby opening a discharging port formed at the discharging portion, to discharge the waste powder and recover the waste powder through the recovery port.

2. A connecting structure to a waste powder recovery container comprising:

a discharging portion including: a discharge pipe disposed in a component part constituting a process unit in an image forming apparatus and provided with a discharging port at a lower portion of a tip of the discharge pipe; an opening/closing member which covers the tip of the discharge pipe, has an inclined surface on a main body side, and is fixed in a freely reciprocating manner in an axial direction of the discharge pipe, so as to open or close the discharging port; and a biasing member for urging the opening/closing member in a projection direction from the discharge pipe; and a recovery port for recovering a waste powder discharged from the component part, the recovery port being formed in a waste powder recovery container detachably attached to the image forming apparatus and disposed at an inclined surface on the container side, the inclined surface being inclined downward in an attachment direction to the image forming apparatus;

wherein when the waste powder recovery container is installed in the image forming apparatus, the inclined surface on the container side presses the inclined surface on the main body side so as to push the opening/closing member to open the discharging port, so that the waste powder discharged from the component part through the recovery port is recovered into the waste powder recovery container.

3. A developing device which circulates and moves a developer contained inside a developer container while agitating the developer by conveying means, supplies the developer to a developer carrier, discards a degraded developer from a discharging portion to a waste powder recovery container, and replenishes a fresh developer from a replenishing portion, the discharging portion in the developer container including: a discharge pipe having a discharging port at a lower portion of a tip of the discharge pipe; an opening/closing member which covers the tip of the discharge pipe, and is fixed in a freely reciprocating manner in an axial direction of the discharge pipe so as to open or close the discharging port; and a biasing member for biasing the opening/closing member in a projection direction from the discharge pipe, and the opening/closing member having an inclined surface on a main body side, inclined upward toward the tip of the discharge pipe;

wherein when the waste powder recovery container is installed in the image forming apparatus, the inclined surface on the main body side is pushed to an inclined surface on a container side, which is formed at the waste powder recovery container, the inclined surface being inclined downward in an attachment direction to the image forming apparatus, and has a recovery port, so as to move the opening/closing member, thus opening the discharging port, so that the degraded developer is recovered to the waste powder recovery container through the recovery port.

4. The developing device according to claim 3, wherein the biasing member is interposed between an extending portion extending from the opening/closing member and a part of the developer container, so as to allow the opening/closing member to move in an axial direction across a part of the discharging portion where discharge pipe is located.

5. An image forming apparatus comprising:

an apparatus main body;

a component part constituting a process unit, housed inside the apparatus main body and provided with a discharging portion, through which waste powder is discharged, the discharging portion including: a discharge pipe having a discharging port formed at a lower portion of a tip of the discharge pipe; an opening/closing member which covers the tip of the discharge pipe, is fixed in a freely reciprocating manner in an axial direction of the discharge pipe, and has an inclined surface on a main body side, the inclined surface on the main body side being inclined upward toward the tip of the discharge pipe, so as to open or close the discharging port; and a biasing member for biasing the opening/closing member in a projection direction from the discharge pipe; and a waste powder recovery container detachably attached to the apparatus main body and provided with a recovery port, through which waste powder discharged from the component part is recovered, at an inclined surface on the container side, the inclined surface on the container side being inclined downward in an attachment direction to the image forming apparatus;

wherein when the waste powder recovery container is installed in the image forming apparatus, the inclined surface on the container side presses the inclined surface on the side of the body, so as to move the opening/closing member, thereby opening the discharging port, so that a degraded developer is recovered to the waste powder recovery container through the recovery port.

6. The image forming apparatus according to claim 5, wherein the component part constituting the process unit, through which the waste powder is discharged, includes:

a developing device for circulating and moving a developer contained in the developer container while agitating the developer by conveying means, supplying the developer to a developer carrier, discarding a degraded developer from the discharging portion to the waste powder recovery container, and replenishing a fresh developer from a replenishing portion; and a cleaner for recovering a toner remaining at the surface of an image carrier;

the waste powder recovery container being vertically bisected into a toner recovery chamber in an upper portion and a developer recovery chamber in a lower portion, wherein the developer recovery chamber has a greater inner space with respect to a height in comparison with the toner recovery chamber;

the recovery port formed at the inclined surface on the container side extending upward from the developer recovery chamber to be positioned at a side of the toner recovery chamber and is inclined downward toward the side of the toner recovery chamber.

* * * * *